US010976106B2

(12) United States Patent
Vouche

(10) Patent No.: US 10,976,106 B2
(45) Date of Patent: Apr. 13, 2021

(54) AIR-COOLED CONDENSER WITH AIR-FLOW DIFFUSER

(71) Applicant: SPG Dry Cooling Belgium, Brussels (BE)

(72) Inventor: Michel Vouche, Marbais (BE)

(73) Assignee: SPG Dry Cooling Belgium, Brussels (BE)

( * ) Notice: Subject to any disclaimer, the term of this patent is extended or adjusted under 35 U.S.C. 154(b) by 0 days.

(21) Appl. No.: 16/476,991

(22) PCT Filed: Jan. 24, 2018

(86) PCT No.: PCT/EP2018/051726
§ 371 (c)(1),
(2) Date: Jul. 10, 2019

(87) PCT Pub. No.: WO2018/138147
PCT Pub. Date: Aug. 2, 2018

(65) Prior Publication Data

US 2019/0353424 A1 Nov. 21, 2019

(30) Foreign Application Priority Data

Jan. 30, 2017 (EP) ..... 17153798

(51) Int. Cl.
*F28B 1/06* (2006.01)
*F28F 13/08* (2006.01)

(52) U.S. Cl.
CPC ..... *F28B 1/06* (2013.01); *F28F 13/08* (2013.01); *F28F 2250/08* (2013.01)

(58) Field of Classification Search
CPC ..... F28F 13/08; F28F 2250/08; F28B 1/06
See application file for complete search history.

(56) References Cited

U.S. PATENT DOCUMENTS 3,612,172 A 10/1971 Dohnt
4,513,813 A * 4/1985 Zanobini ..... F28B 1/06 165/110

(Continued)

FOREIGN PATENT DOCUMENTS

| | | |
|---|---|---|
| DE | 1126430 | 3/1962 |
| GB | 908429 | 10/1962 |
| GB | 920401 | 3/1963 |

OTHER PUBLICATIONS

International Searching Authority, "Search Report," issued in connection with U.S. Appl. No. PCT/EP2018/051726, dated May 2, 2018, 3 pages.

(Continued)

*Primary Examiner* — Shafiq Mian
(74) *Attorney, Agent, or Firm* — Hanley, Flight and Zimmerman, LLC

(57) ABSTRACT

The present invention relates to an air-cooled condenser (1) for condensing steam. The air-cooled condenser comprises one or more roof-shaped heat exchanger assemblies (51,52, 53,54,55,56).

A plenum space (60) is located between a top boundary delineated by the one or more roof-shaped heat exchanger assemblies (13,14) and a bottom boundary delineated by a deck cover (17). A ducted fan (5) is provided for generating an air-flow. The air-cooled condenser according to the invention comprises an air-flow diffuser (8) having an air inlet side connected to an upper side of the cylindrical duct (7) of the ducted fan and an air outlet side coupled with the deck cover such that, when in operation, an air-flow generated by the fan is flowing through the air-flow diffuser before entering the plenum space via a deck opening (18) in the (Continued)

deck cover. The cross sectional area and the height of the air-flow diffuser are optimized to reduce the electrical power consumption of the fan.

15 Claims, 8 Drawing Sheets

(56) References Cited

U.S. PATENT DOCUMENTS

| | | | | |
|---|---|---|---|---|
| 5,656,281 | A * | 8/1997 | Hytte | A01N 57/12 424/408 |
| 6,474,272 | B2 * | 11/2002 | Bensing | B01D 5/0012 122/459 |
| 7,497,250 | B2 * | 3/2009 | Coy | F28B 1/06 165/122 |
| 8,191,259 | B2 * | 6/2012 | Schabosky | F28B 1/06 29/890.07 |
| 2015/0330709 | A1 * | 11/2015 | Vouche | F28B 7/00 202/185.3 |

OTHER PUBLICATIONS

International Searching Authority, "Written Opinion," issued in connection with U.S. Appl. No. PCT/EP2018/051726, dated May 2, 2018, 6 pages.

* cited by examiner

AIR-COOLED CONDENSER WITH AIR-FLOW DIFFUSER

RELATED APPLICATIONS

This patent arises from the U.S. national stage of International Patent Application Serial No. PCT/EP2018/051726, having an international filing date of Jan. 24, 2018, and claims benefit of European Patent Application No. 17153798.8, filed on Jan. 30, 2017, which are hereby incorporated by reference in their entireties for all purposes.

FIELD OF THE INVENTION

The invention is related to an air-cooled condenser for condensing steam. More specifically, it relates to an air-cooled condenser comprising one or more roof-shaped heat exchanger assemblies. Such an air-cooled condenser comprises a plenum space located between a top boundary delineated by the one or more roof-shaped heat exchanger assemblies and a bottom boundary delineated by a deck cover. A ducted fan is provided for blowing an air flow into the plenum space.

DESCRIPTION OF PRIOR ART

Various air-cooled condenser types for condensing steam are known in the art. The air-cooled condensers (ACC) make use of heat exchangers which generally comprise a number of finned condensing tubes arranged in parallel forming a heat exchanger panel. The tubes of the heat exchanger panels are in contact with the ambient air and when steam passes through the tubes, the steam gives off heat and is eventually condensed.

Some air-cooled condensers make use of a roof-shaped geometry where a first heat exchanger panel and a second heat exchanger panel are inclined with respect to a horizontal level and are separated by an opening angle $\delta$, typically in the range $35° \leq \delta \leq 70°$. In other words, the first and second heat exchanger panel are forming the roof of the roof-shaped heat exchanger assembly.

Under the roof of the roof-shaped heat exchanger assembly, a plenum space or roof space is created. This plenum space is located between an upper boundary delineated by the first and second heat exchanger panels and by a lower boundary delineated by a deck cover. The deck cover is positioned parallel with the horizontal plane. Optionally, the plenum space is further enclosed by gable panels and/or side panels. An example of an air-cooled condenser using roof-shaped heat exchanger assemblies is described in US2009/0220334, "Fan shroud for heat exchange tower fans". These type of roof-shaped heat exchangers are also named A-frame type or delta-type heat exchangers.

In view of the large amount of steam to condensate, e.g. exhaust steam from a turbine, large heat exchanger panels are used. As also discussed in US2009/0220334, ducted fans are used to generate an air-flow through these large heat exchanger panels. Each ducted fan comprises a rotatable fan that is located below the roof-shaped heat exchanger assembly so that, when in operation, an air draft is forced from the space below the fan towards the plenum space of the roof-shaped heat exchanger assembly. The deck cover comprises a deck opening for receiving the air-flow generated by the fan such that the air-flow can enter the plenum space.

As illustrated in FIG. 3 and FIG. 5 of US2009/0220334, the ducted fans are surrounded by a cylindrical duct, also named fan housing, fan body or sometimes also named fan shroud.

The air-cooled condenser is elevated at a height, typically between 4 and 30 meter, above a ground floor using an elevating frame structure that is resting on the floor. In this way, the air-cooled condenser has the form of a tower.

An air-cooled condenser is generally an assembly of so-called air-cooled condenser streets wherein each ACC street comprises a plurality of ACC modules. An ACC module is hereby defined as a part of an air-cooled condenser street that comprises components associated to a fan, including the fan with its motor, the fan supporting structure and the heat exchanger panels associated to the fan. An ACC module can comprise a single roof-shaped heat exchanger or multiple roof-shaped heat exchangers placed adjacently to each other. In the latter case, a single fan can for example be configured to generate an air-flow in the multiple roof-shaped heat exchangers. In other examples, an ACC module can comprise multiple fans to generate an air-flow through the heat exchanger panels of the module.

As the ACC modules are placed in a row, forming an ACC street, a main steam manifold can supply steam to the heat exchanger panels of multiple modules. One or more of these air-cooled condenser streets are then placed adjacently to each other for forming an air-cooled condenser. Hence, an air cooled condenser with ACC streets and ACC modules comprises a large quantity of fans, for example 4 to 50 fans.

A disadvantage of these air-cooled condensers is that in order to have a sufficient air volume to circulate, large fans with blade diameters of more than 10 meter need to be used. As a consequence, ACC facilities comprising multiple ACC modules are consuming a large amount of electrical power to operate the multiple fans.

SUMMARY OF THE INVENTION

It is an object of the present invention to provide an air-cooled condenser wherein the electrical power consumption resulting from the motorized fans is reduced. This object and other aspects of the invention are achieved with the apparatus as claimed.

According to the invention, an air-cooled condenser for condensing steam is provided. Such an air-cooled condenser comprises one or more roof-shaped heat exchanger assemblies. Each of these heat exchanger assembly comprises a first heat exchanger panel and a second heat exchanger panel that are inclined with respect to a horizontal plane X-Y formed by a horizontal axis X and a longitudinal axis Y perpendicular to the axis X.

The air-cooled condenser further comprises a plenum space located between a top boundary delineated by the one or more roof-shaped heat exchanger assemblies and a bottom boundary delineated by a deck cover. This deck cover is positioned parallel with the horizontal plane X-Y and comprises a deck opening for receiving an air-flow.

The air-cooled condenser also comprises a ducted fan for blowing air into the plenum space. Such a ducted fan comprises a fan and a cylindrical duct surrounding the fan. The ducted fan is configured such that the fan is rotatable around a rotation axis R that is parallel with a vertical axis Z perpendicular to the axes X and Y, and the cylindrical duct has an inner circular diameter $\Phi F$ and a corresponding cross sectional area SF.

The air-cooled condenser according to the invention is characterized in that it further comprises an air-flow diffuser having an air inlet side connected to an upper side of the cylindrical duct and having an air outlet side coupled with the deck cover such that, when in operation, an air-flow generated by the fan is flowing through the air-flow diffuser before entering the plenum space via said deck opening.

The air-cooled condenser according to the invention is further characterized in that the air-flow diffuser has a height H1 measured along the vertical axis Z and an inner cross sectional area S obtained by intersecting the air-flow diffuser with a plane parallel with the horizontal plane X-Y, and wherein the cross sectional area S is increasing from a value $S1 \geq SF$ at the air inlet side to a value $S2 > S1$ at the air outlet side, and wherein $1.01 \leq S2/S1 \leq 1.93$ and $5 \leq (\Phi F/H1) \leq 28$.

Advantageously, by connecting the air inlet side of the air-flow diffuser to an upper side of the cylindrical duct of the ducted fan and by coupling the air outlet side of the air-flow diffuser with the deck cover, the speed and speed distribution of the air-flow can be altered before the air is entering the plenum space. By designing an air-flow diffuser wherein $1.01 \leq S2/S1 \leq 1.92$ and wherein $5 \leq (\Phi F/H1) \leq 28$, part of the dynamic pressure is transformed into static pressure when the air-flow passes through the opening of the deck cover. In this way, the total pressure drop, compared to prior art air cooled condensers not using an air-flow diffuser, is reduced and hence the power consumption of the fan is reduced.

In preferred embodiments, the number of heat exchanger assemblies delineating the top boundary of the plenum space is equal or larger than two.

Preferably, the air-flow condenser comprises two to seven heat exchanger assemblies that are positioned adjacently to each other so as to form a row of heat exchanger assemblies extending along the horizontal axis X and wherein the two to seven heat exchanger assemblies are delineating the upper boundary of the plenum space.

In embodiments, the air-flow diffuser has a shape of a hollow truncated right circular cone or a shape of a hollow right frustum. Typically, for these shapes, the ratios of S2/S1 and ΦF/H1 are in the range $1.01 \leq S2/S1 \leq 1.55$ and $5 \leq (\Phi F/H1) \leq 28$.

In preferred embodiments, the air-flow diffuser has a shape of a circular cone with a cone opening angle $\alpha$ larger than 14° and with $1.01 \leq S2/S1 \leq 1.55$ and $5 \leq (\Phi F/H1) \leq 28$.

Generally, the air-cooled condenser according to the invention comprises a bell-mouth fan inlet or a conical fan inlet coupled to a bottom side of the cylindrical duct. Advantageously, a bell-mouth or a conical fan inlet can improve the air-flow distribution at the fan entrance and reduce air recirculation.

In some embodiments, the first and said second heat exchanger panels of each of the one or more roof-shaped heat assemblies comprise condensing tubes having a length between 1.5 m and 2.5 m.

The air-cooled condensers according to the invention comprising an elevating frame structure that is resting on a ground floor. This elevating frame structure is configured such that a distance HD, measured along the axis Z, between a center plane of the ducted fan and the ground floor is larger than 4 meter. The center plane is a plane parallel with the horizontal plane X-Y.

SHORT DESCRIPTION OF THE DRAWINGS

These and further aspects of the invention will be explained in greater detail by way of example and with reference to the accompanying drawings in which:

FIG. 1*a* is a schematic representation of a front view of a roof-shaped heat exchanger assembly comprising first and second heat exchanger panels inclined with respect to a horizontal plane X-Y;

FIG. 1*b* is a schematic representation of a side view of a heat exchanger panel having a length PL along the Y axis;

FIG. 2*a* illustrates a plenum space located between a top boundary delineated by a single roof-shaped heat exchanger assembly and a bottom boundary delineated by a deck cover;

FIG. 2*b* illustrates a further example of a plenum space located between a single roof-shaped heat exchanger assembly and a deck cover;

FIG. 2*c* illustrates a plenum space located between a top boundary delineated by two roof-shaped heat exchanger assemblies and a bottom boundary delineated by a deck cover positioned parallel with the horizontal plane X-Y;

The figures are not drawn to scale. Generally, identical components are denoted by the same reference numerals in the figures.

DETAILED DESCRIPTION OF PREFERRED EMBODIMENTS

The air-cooled condensers according to the invention are used for condensing steam, for example for condensing exhaust steam from a turbine. Such an air-cooled condenser comprises one or more roof-shaped heat exchanger assemblies. The roof-shaped heat exchanger assembly 51 comprises, as shown for example on FIG. 1*a*, a first 13 and a second 14 heat exchanger panel inclined with respect to a horizontal plane X-Y formed by a horizontal axis X and a longitudinal axis Y perpendicular to the axis X.

Typically, the first 13 and second 14 heat exchanger panel of a roof-shaped heat exchanger assembly are separated by an opening angle $\delta$ in the range $35° \leq \delta \leq 70°$. This opening angle $\delta$ is indicated on FIG. 1*a*.

Figure 1B:
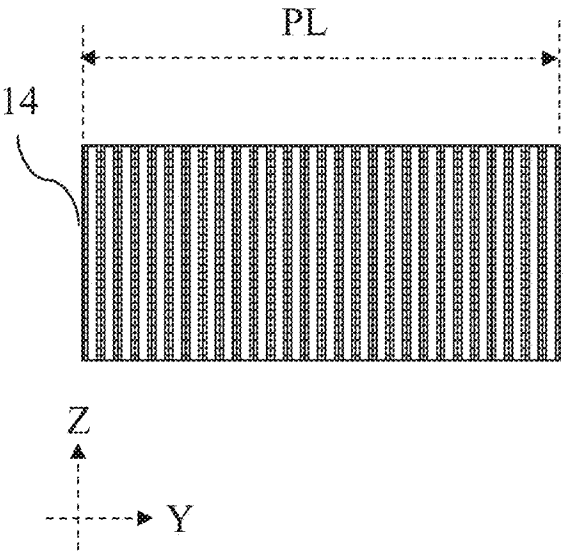
Figure 1A:
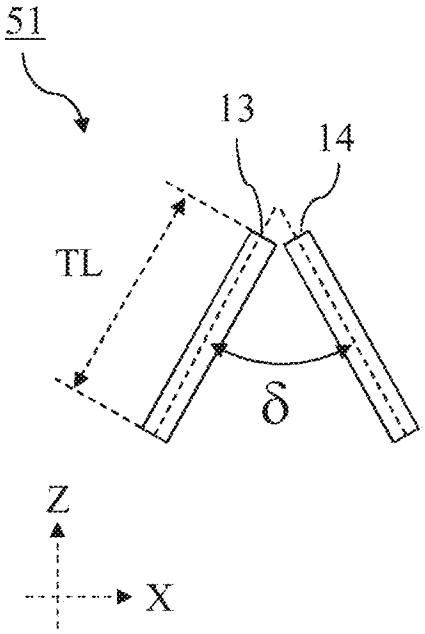

As known in the art, each heat exchanger panel comprises a plurality of parallel oriented finned condensing tubes. The condensing tubes can have different lengths depending on the type of heat exchanger panels used. In some embodiments, using large heat exchanger panels, the condensing tubes have a tube length TL in the range of $8\ m \leq TL \leq 12\ m$. In other embodiments, where more compact panels are used, the condensing tubes have a tube length TL in the range of $1.5\ m \leq TL \leq 3\ m$. The length TL of the tubes corresponds to the distance between the lower end and the upper end of the tubes and defines the width of the heat exchanger panels, as illustrated on FIG. 1*a*. The number of tubes in the heat exchanger panel define the length PL of the panel in the Y direction as illustrated in FIG. 1*b*.

Figure 2C:
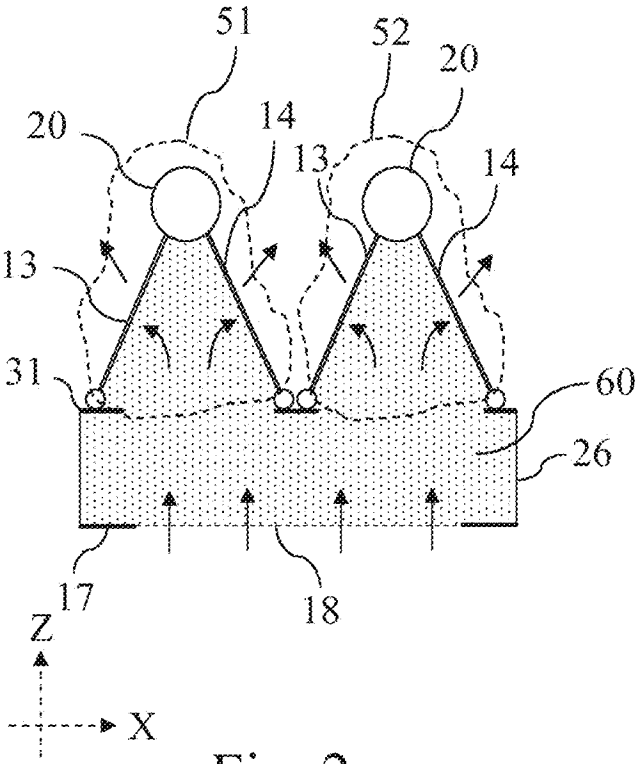
Figure 2B:
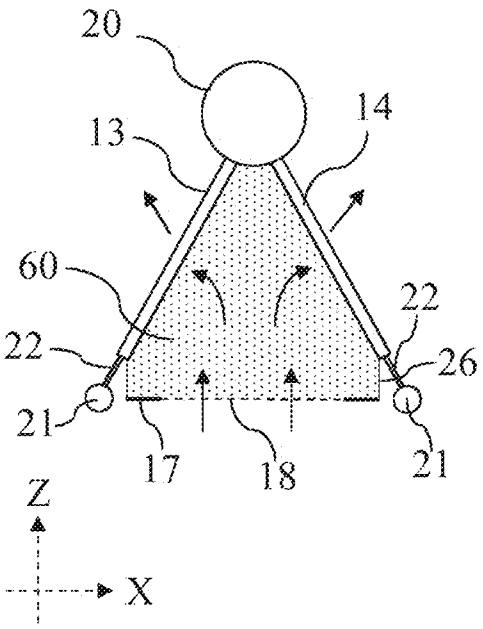
Figure 2A:
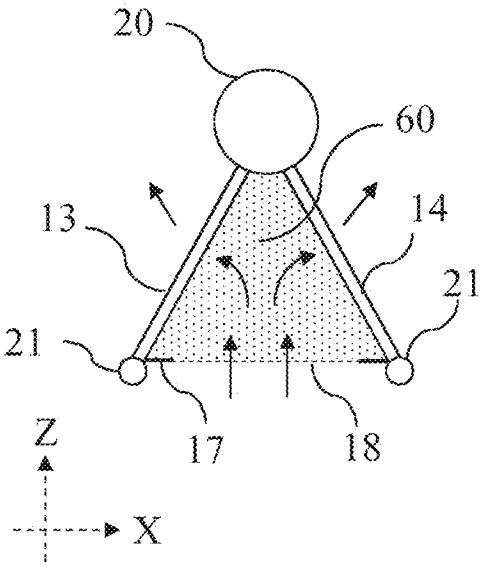

A main steam manifold 20, schematically illustrated in FIG. 2*a* to FIG. 2*c*, supplies steam to the heat exchanger panels. The steam manifold can either comprise a single tube supplying steam to both the first 13 and second 14 heat exchanger panel or, alternatively, the main steam manifold 20 can comprise two separate tubes, one for supplying steam to the first heat exchanger panel 13 and one for supplying steam to the second heat exchanger panel 14. The condensate formed in the tubes is flowing by gravity to the steam/condensate manifolds 21 where the condensate is collected and then further transported. The steam/condensate manifolds 21 are also schematically illustrated on the FIGS. 2*a* to 2*c*. In the specific embodiment shown on FIG. 2*b* connecting pipes 22 are connecting the tubes from the heat exchanger panel with the steam/condensate manifold 21. In other embodiments as shown in FIG. 2*a* and FIG. 2*c*, the tubes of the heat exchanger panel are directly connected to the steam/condensate manifold 21.

In embodiments according to the invention, the heat exchanger panels comprise state of the art single row tubes. The cross sections of these single row tubes can have for example a rectangular shape or alternatively an elliptical shape. In other embodiments, multiple layer round core tubes can be placed in parallel for forming the heat exchanger panels.

Figure 4:
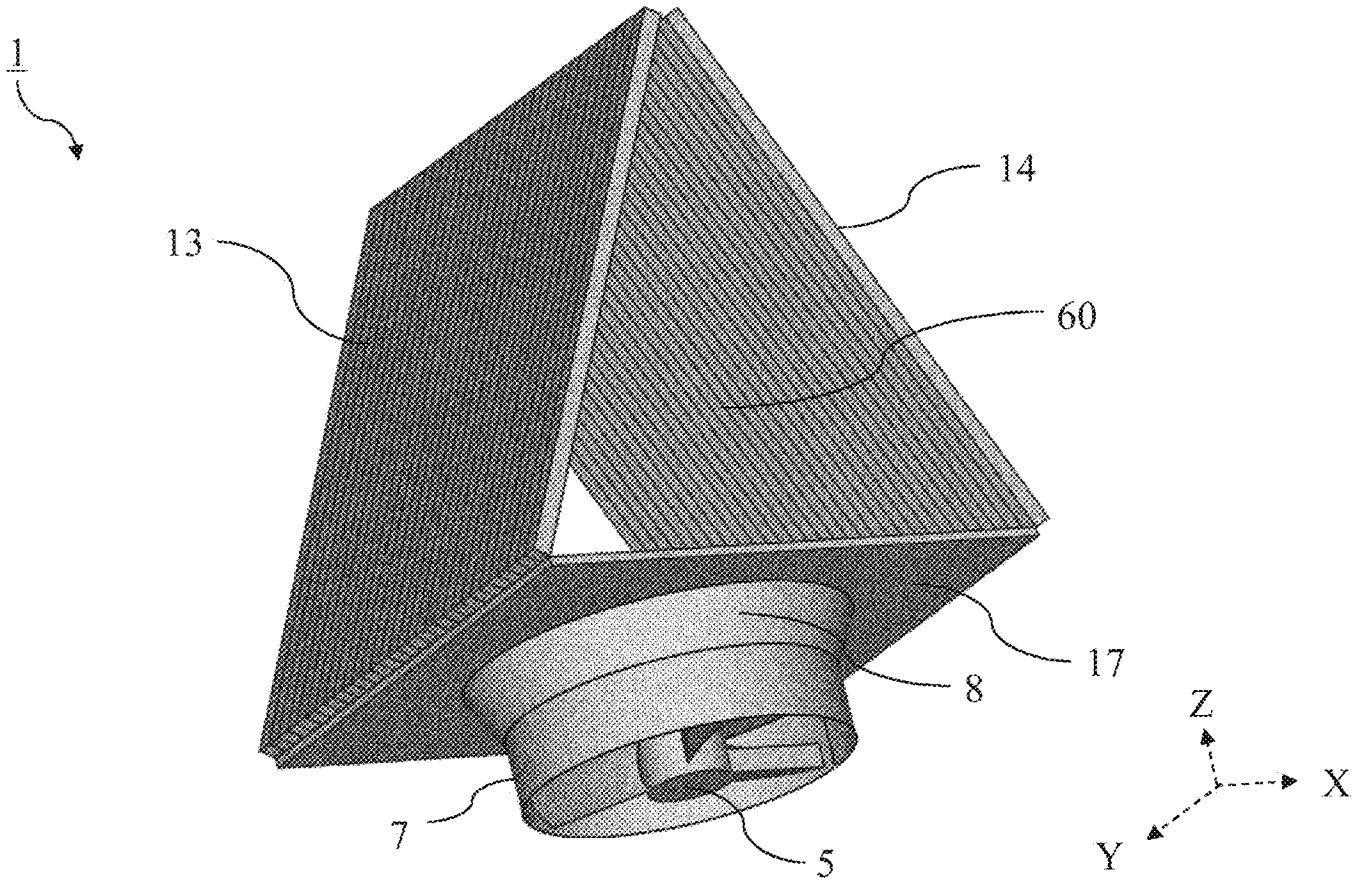
FIG. 4 shows a perspective view of an air-cooled condenser according to the invention comprising a single roof-shaped heat exchanger assembly.
Figure 5:
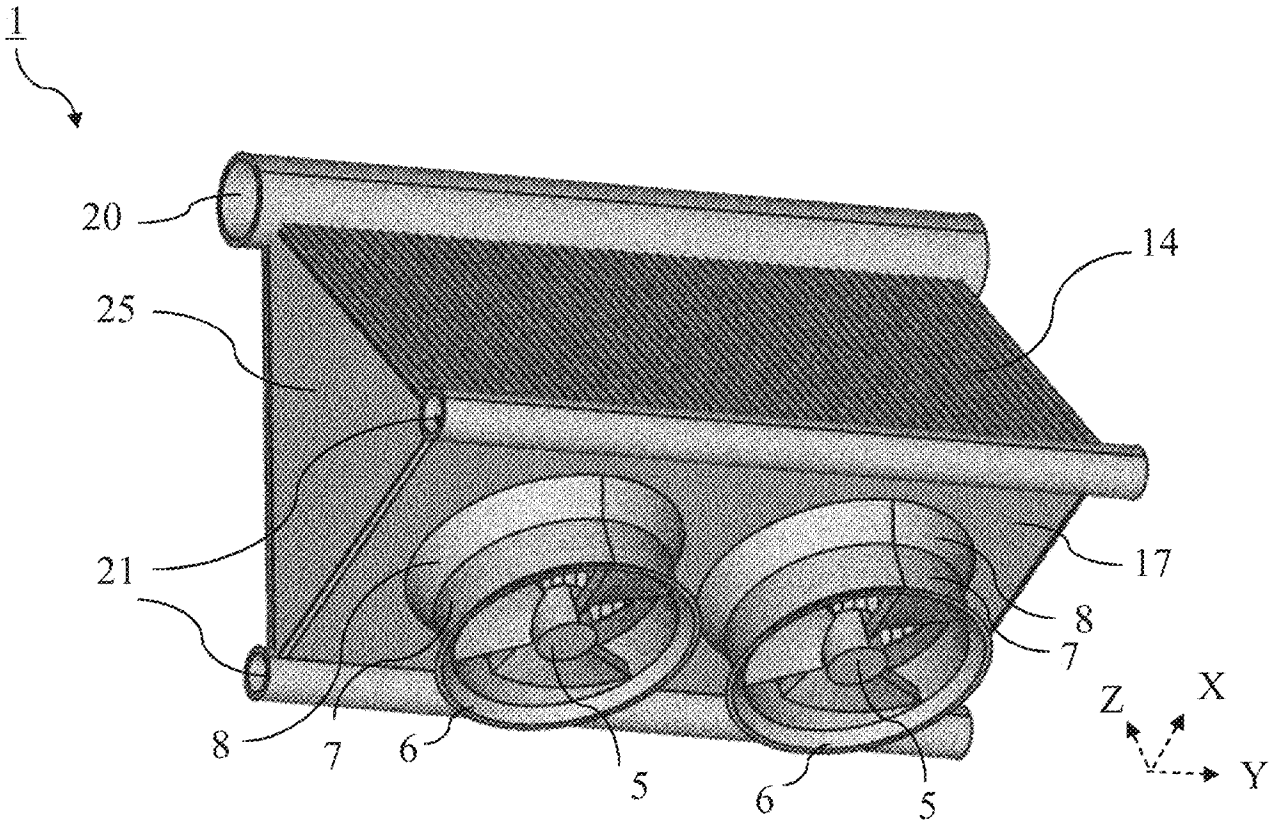
FIG. 5 shows a perspective view of an air-cooled condenser according to the invention comprising a single roof-shaped heat exchanger and two fans.
Figure 6:
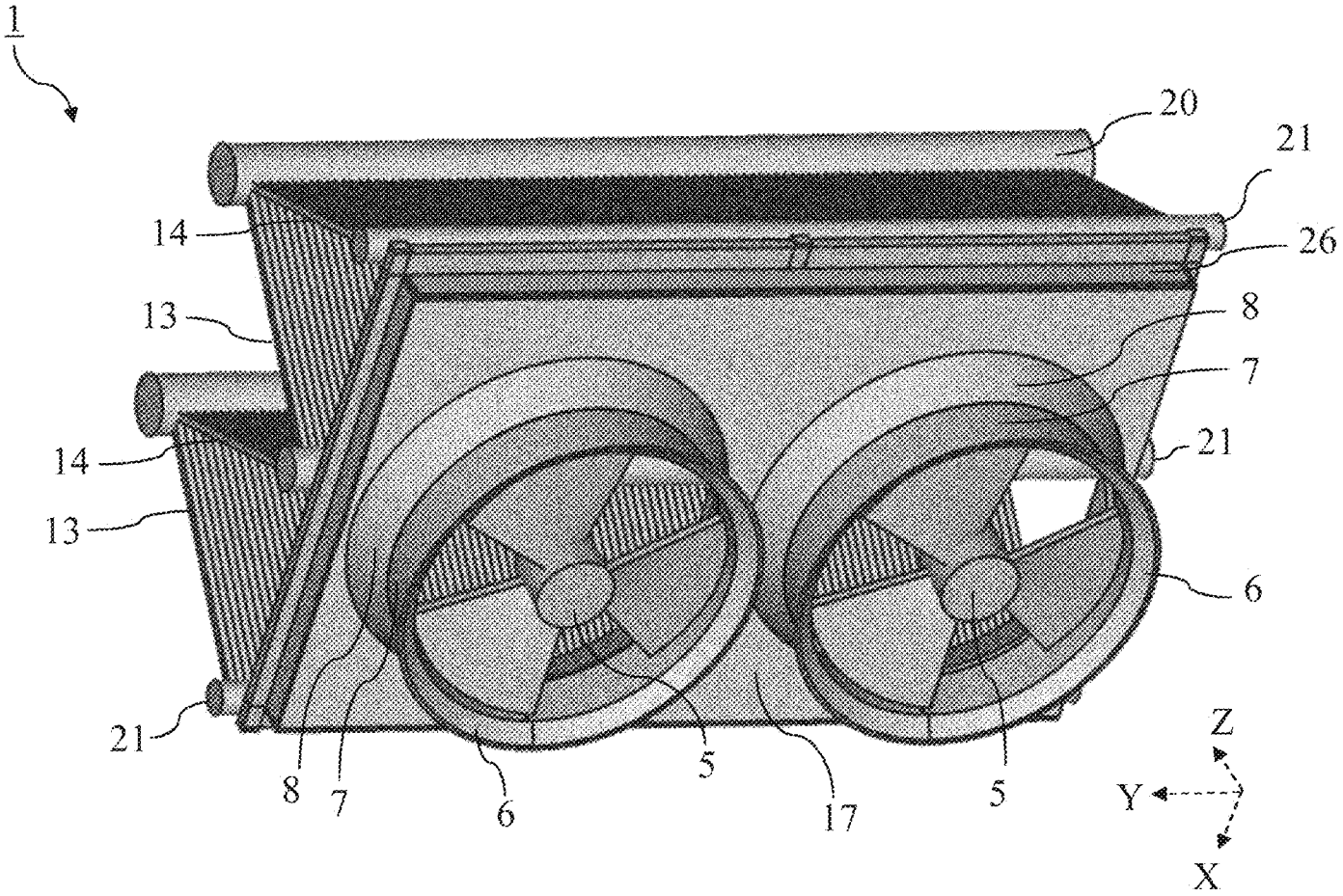
FIG. 6 shows a perspective view of an air-cooled condenser according to the invention comprising two roof-shaped heat exchanger assemblies and two fans.

Perspective views of examples of air-cooled condensers according to the invention are schematically shown on FIG. 4 to 6. One or more ducted fans are used to generate an air flow for cooling the heat exchanger panels. The example shown on FIG. 4 comprises one roof-shaped heat exchanger assembly and one ducted fan and the example shown on FIG. 5 comprises one roof-shaped heat exchanger assembly and two ducted fans. FIG. 5 illustrates an air-cooled condenser with two roof-shaped heat exchanger assemblies and two ducted fans.

Figure 3:
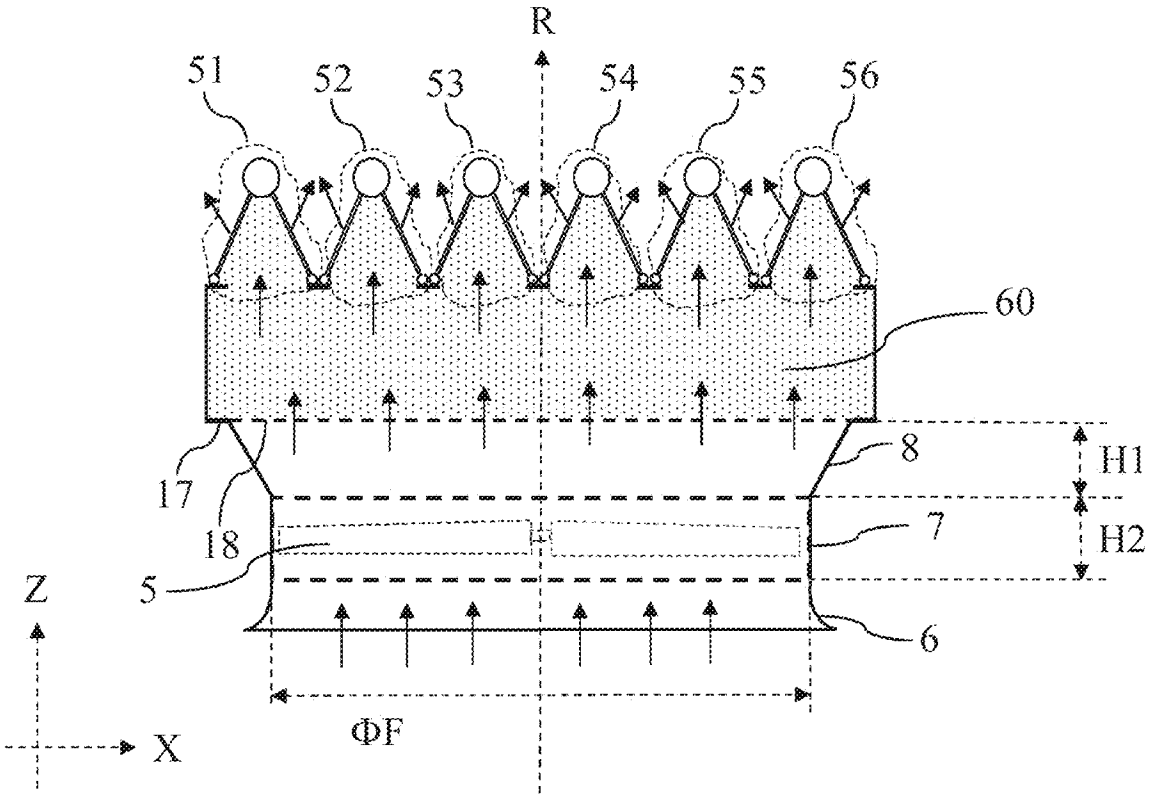
FIG. 3 shows an air-cooled condenser comprising six roof-shaped heat exchanger assemblies and an air-flow diffuser located between a plenum space and a ducted fan.

FIG. 3 shows a cross sectional view of an air-cooled condenser according to the invention comprising six roof-shaped heat exchanger assemblies. The embodiments of the current invention are not limited by the number of roof-shaped heat exchanger assemblies nor by the number of ducted fans.

The air-cooled condenser according to the invention comprises a plenum space 60. The plenum space 60 is located between a top boundary and a bottom boundary. The top boundary is delineated by the one or more heat exchanger assemblies, i.e. by the first 13 and second 14 heat exchanger panels of each of the one or more roof-shaped heat exchanger assemblies. The bottom boundary is delineated by a deck cover 17 positioned parallel with the horizontal plane X-Y. As shown on FIG. 2*a* to FIG. 2*c*, the shape and volume of the plenum space 60, illustrated with a dotted pattern on these figures, can be different depending on the specific geometry and the number heat exchanger assemblies. What the embodiments of the air-cooled condenser according to the invention have in common is that the plenum space 60 has this top boundary delineated by the heat exchanger assemblies and the bottom boundary delineated by the deck cover 17. In other words, the top boundary has to be construed as the ceiling and the bottom boundary has to be construed as the floor of the plenum space 60.

In the embodiment of FIG. 2*a*, the plenum space 60 corresponds to the roof space under the first 13 and second 14 heat exchanger panels and has the typical shape of a triangular prism. In the embodiment of FIG. 2*b*, the plenum space 60 comprises an upper space having the shape of a triangular prism and a lower space, adjacent to the upper space, that has the shape of a rectangular cuboid.

As mentioned above, the embodiment illustrated in FIG. 2*c* comprises two roof-shaped heat exchanger assemblies. As a consequence, the plenum space 60 shown on FIG. 2*c* comprises an upper space formed by two triangular prisms and a lower space formed by a rectangular cuboid.

The deck cover 17, positioned parallel with the horizontal plane X-Y, comprises a deck opening 18 for receiving an air-flow. The arrows on FIG. 2*a* to FIG. 2*c* illustrate the air-flow, from entering the deck opening 18, flowing through the plenum space before finally exiting the plenum space through the openings of the first and second heat exchanger panels.

The deck cover 17 has to be construed as a floor or a base of the plenum space. The deck cover typically comprises a number of cover plates made of for example galvanized steel sheets and a number of reinforcing and supporting beams. The deck cover 17 not only allows to walk inside the roof-shaped heat exchanger assembly but also avoids that the air, forced in the plenum space, is escaping or recirculating downwards.

In preferred embodiments, the number of heat exchanger assemblies delineating the top boundary of the plenum space is equal or larger than two. In the example shown on FIG. 3, six heat exchanger assemblies 51,52,53,54,55 and 56 are delineating the top boundary of the plenum space.

In preferred embodiments, the air-cooled condenser according to the invention comprises two to seven of the heat exchanger assemblies. These two to seven heat exchanger assemblies are positioned adjacently to each other so as to form, as illustrated on FIG. 2*c* and FIG. 3, a row of heat exchanger assemblies extending along the horizontal axis X. The two to seven heat exchanger assemblies are delineating the upper boundary of the plenum space 60. Generally, when using such a plurality of heat exchanger assemblies, more compact heat exchanger panels are used wherein the condensing tubes have lengths TL between 1.5 m and 2.5 m.

The ducted fan comprises a fan 5 and a cylindrical duct 7 surrounding the fan 5. As shown on FIG. 3, the ducted fan is configured such that the fan is rotatable around a rotation axis R parallel with a vertical axis Z, perpendicular to the axes X and Y. The cylindrical duct 7 has an inner circular diameter ΦF, as illustrated on FIG. 3, and a corresponding cross sectional area SF.

The air-flow condenser according to the invention comprises an air-flow diffuser 8 having an air inlet side and an air outlet side. The air-flow diffuser can for example have the shape of a hollow truncated cone. An example of a conical air-flow diffuser is shown on FIG. 7 where the air inlet side has an inner cross sectional area S1 and the air outlet side has an inner cross sectional area S2>S1. The inner cross sectional area is obtained by intersecting the air-flow diffuser 8 with a plane parallel with the horizontal plane X-Y. On FIG. 7, the cross sectional areas S1 and S2 are shaded for illustrative purposes.

As illustrated on FIG. 3, the air inlet side of the air-flow diffuser is connected to an upper side of the cylindrical duct 7 and the air outlet side of the air-flow diffuser is coupled with the deck cover 17. The upper side of the cylindrical duct 7 has to be construed as the air outlet side of the cylindrical duct 7, i.e. the side where the air flow generated by the fan leaves the cylindrical duct 7. In this way, when in operation, an air-flow generated by the fan 5 is flowing through the air-flow diffuser before entering the plenum space 60 via the deck opening 18. The arrows on FIG. 3 schematically illustrate the air flow through the air-cooled condenser. The fan forces ambient air into the air-flow diffuser 8, the air flows further through the air-flow diffuser until the air is entering the plenum space 60 through the opening 18 of the deck cover 17. The air is finally leaving the plenum space through the openings of the heat exchanger panels.

The coupling of the air outlet side of the air-flow diffuser 8 with the deck cover 17 has to be construed as a mainly air-tight connection, i.e. the air-flow generated by the ducted fan is mainly entering the plenum space through the opening in the deck cover and hence air-flow losses are reduced. In embodiments, the coupling of the air-flow diffuser 8 with the deck cover 17 has also to be construed as a fixation or attachment allowing the deck cover to support the weight of the air-flow diffuser and the weight of the ducted fan connected to the air-flow diffuser.

Figure 7:
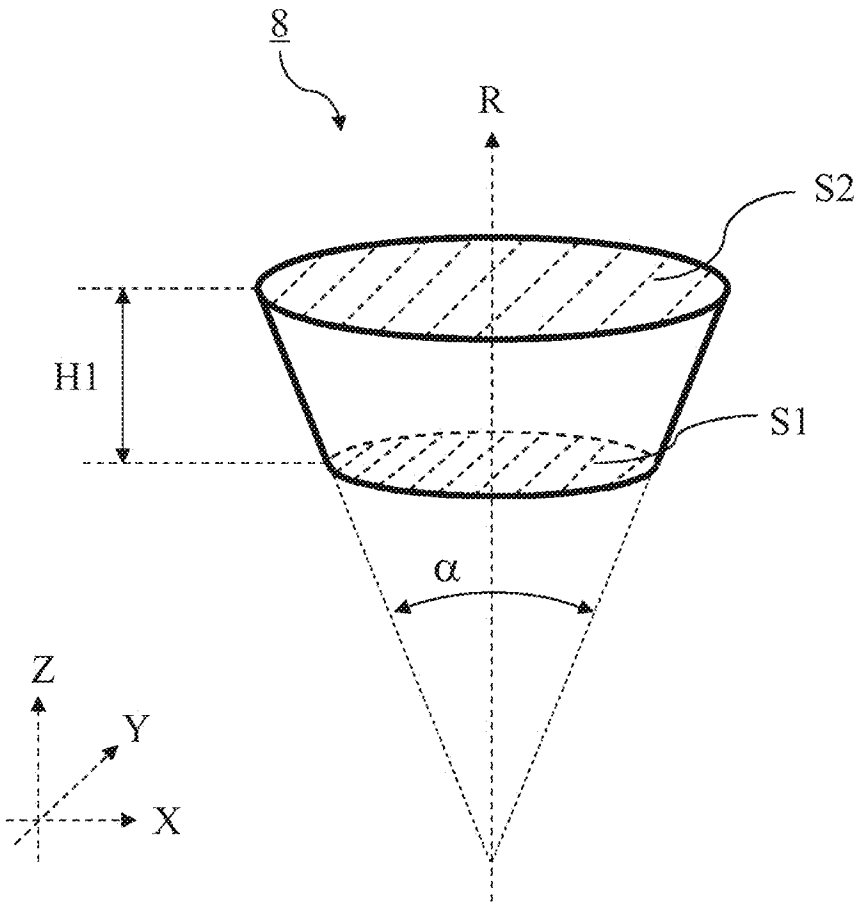
FIG. 7 shows a conical air-flow diffuser according to the invention having a cross sectional area S1 at the air inlet side and a cross sectional area S2 at the air outlet side.

As illustrated on FIG. 3 and FIG. 7, the air-flow diffuser 8 has a height H1 measured along the vertical axis Z and, as mentioned above, an inner cross sectional area S obtained by intersecting the air-flow diffuser 8 with a plane parallel with the horizontal plane X-Y. This inner cross sectional area S is increasing from a value $S1 \geq SF$ at the inlet side to a value $S2 > S1$ at the outlet side. The air diffuser 8 is characterized in that $1.01 \leq S2/S1 \leq 1.93$, and that $5 \leq (\Phi F/H1) \leq 28$.

Preferably, as shown on FIG. 3, FIG. 5 and FIG. 6, a fan bell-mouth inlet or a fan conical inlet 6 is coupled to the bottom side of the cylindrical duct 7. It is known in the art that a bell-mouth or a conical fan inlet can improve the air-flow distribution at the fan entrance and reduce air recirculation.

The air-flow diffuser 8 according to the invention is not limited to a specific shape. The air-flow diffuser 8 has to be construed as any hollow body that has the characteristics defined above with respect to its height H1 and with respect to the variation of its cross sectional area from the air inlet side to the air outlet side of the air-flow diffuser. In some embodiments, the air-flow diffuser 8 has a shape of a hollow truncated right circular cone and in other embodiments the diffuser 8 has a shape of a hollow right frustum.

In alternative embodiments, the cross sectional area S1 at the inlet side of the air-flow diffuser 8 has a circular shape and the cross sectional area S2 at the outlet side of the air-flow diffuser 8 has a square shape.

In other embodiments, the air-flow diffuser according to the invention is a so-called multistage conical diffuser. A multistage conical diffuser comprises multiple sub diffusers with different cone angles and wherein the sub diffusers are placed in series. The height of each of the sub diffusers is configured such that the sum of the heights of all the sub diffusers is equal to H1, the total height of the multistage conical diffuser. Generally, the cone angle of the sub diffuser that is coupled to the deck cover has the largest cone angle, while the sub diffuser coupled to the ducted fan has a smaller cone angle.

In further embodiments the air-flow diffuser 8 comprises a bell-mouth diffuser outlet or a conical diffuser outlet. In these embodiments, the bell-mouth or conical diffuser outlet is forming the air outlet side of the air-flow diffuser.

The air-flow diffuser as well as the cylindrical duct of the ducted fan are, for example, made of a composite material such as fibre-reinforced polymer (RFP). In other embodiments, galvanized steel sheets are used.

In some embodiments, the air-flow diffuser and the cylindrical duct of the ducted fan are made as a single element while in other embodiments the air-flow diffuser and the cylindrical duct are made as two separated elements and attached to each other in the factory or during the erection of the air-cooled condenser.

In preferred embodiments $S1=SF$, i.e. the ratio of the inner section at the air-flow diffuser inlet is equal to the inner section of the cylindrical duct of the ducted fan so as to have a smooth transition from the ducted fan towards the air-flow diffuser. In alternative embodiments, $S1>SF$, for example for a configuration where the inner cross section at the inlet side of the air-flow diffuser has a square shape with a width equal to the inner diameter of the cylindrical duct of the ducted fan.

Ducted fans used with air-cooled condensers are known in the art and are for example described in US2009/0220334 where it is illustrated that the fans with their associated cylindrical duct are located just below the plenum space of the heat exchanger assemblies. Depending on the size of the plenum space, the inner diameter of the cylindrical duct can vary between 2 m and 12 m. The fan comprises an electrical motor with power characteristics selected in accordance with the air-flow rate required for cooling the heat exchanger panels. The inner circular diameter ΦF of the cylindrical duct 7 is selected as function of the diameter of the fan, typically the ratio between the fan diameter and the diameter of the cylindrical duct 7 is larger than 90%. The diameter of the fan is hereby defined as the diameter of a circle made by the outer tips of the fan blades when the fan is in operation.

Figure 8:
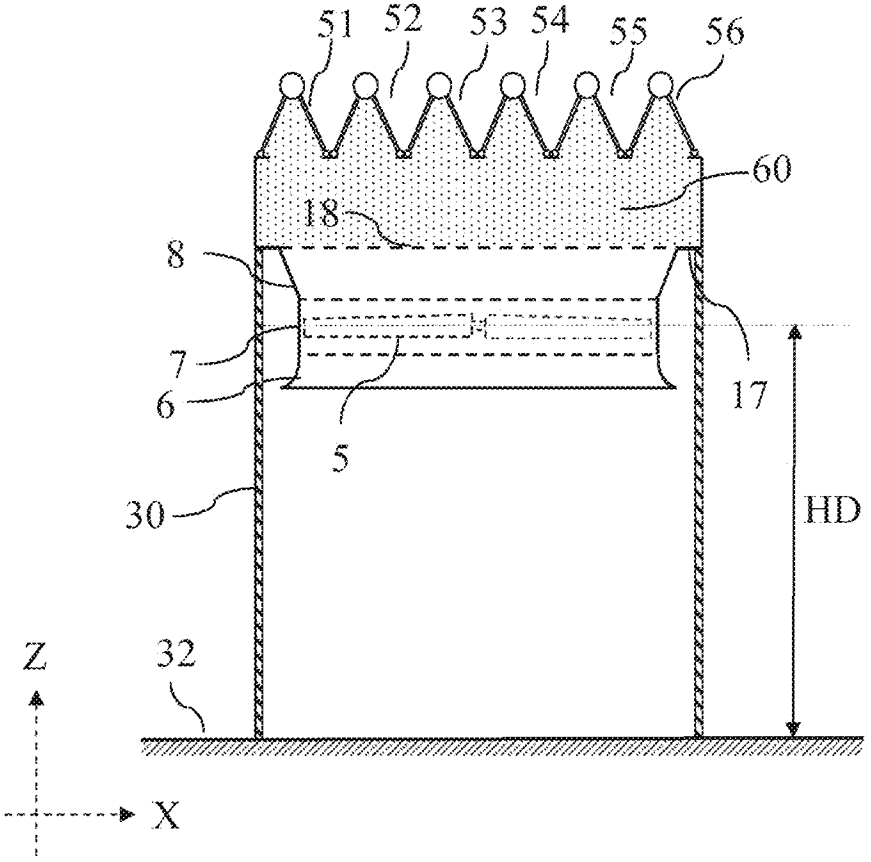
FIG. 8 shows a cross sectional view of a schematic representation of an air-cooled condenser comprising an elevating frame structure.

As known in the art, and disclosed for example in US2009/0220334, ACC condensers have to be elevated at a given height, typically between 4 meter and 30 meter, above a ground floor to allow for a sufficient and efficient air-flow supply to the fans. As shown on FIG. 8, the air-cooled condenser comprises an elevating frame structure 30 resting on the ground floor 32. The elevating frame structure 30 is generally a lattice framework comprising columns and girts interconnected with each other so as to form an open frame structure.

Generally, a distance HD between a center plane of the ducted fan and the ground floor 32, measured along the axis Z, is larger than 4 meter. The center plane of the ducted fan is illustrated on FIG. 8 as a horizontal dotted line and is defined as a plane parallel with the X-Y plane and dividing the cylindrical duct 7 at mid-height. This height HD typically corresponds to the location of the fan with respect to the ground floor 32.

As the elevating structure involves a large cost factor, the ACC's are generally designed to avoid any additional element that would further increase the height of the ACC. Therefore, in prior art air-cooled condensers, the ducted fan is placed as close as possible to the plenum space as shown for example on FIG. 1 of US2009/0220334.

The embodiments according the current invention have an additional element that will increase the height of the ACC's, namely the air-flow diffuser 8. However, the inventors have designed an air-flow diffuser 8 that is optimized to improve the performance of the fan and at the same time to limit the increase of the height of the ACC.

The inventors have found that by designing the air-flow diffuser 8 where the cross sectional area S is increasing from a value $S1 \geq SF$ at the inlet side to a value $S2>S1$ at the outlet side and wherein the ratio S2/S1 and the ratio ΦF/H1 fall within the above defined limits, the power consumption of the fan can be strongly reduced.

As discussed above, the air-flow diffuser according to the invention has a ΦF/H1 ratio in the range $5 \leq (\Phi F/H1) \leq 28$. This indicates that the air-flow diffuser has a height that is short compared to the diameter of the fan. With an air-flow diffuser having such a small height, it is avoided to have to place the ACC at a much higher height with respect to a ground floor. But on the other hand, with a short air-flow diffuser it is normally not expected to obtain much improvement in terms of total pressure drop compared with an air cooled condenser using only the standard ducted fan without an air-flow diffuser or it is even possible to expect worse results.

What shape to use for the transition element transporting the air-flow from the fan towards the plenum space of an ACC, depends on many parameters. It is known in the art that for geometries where air is transported in tubes or channels such as air-conditioning systems, when a transition from a smaller diameter to a larger diameter needs to be made, a conical transition element can advantageously be used. It is known in the art that, for a conical transition element, an optimum opening angle of 7° is recommended. For larger angles, there is separation of the air-flow from the walls resulting in turbulences. This results in a larger total pressure drop and hence performance losses of the fan. The optimum opening angle of 7° is however for a very long diffuser having a ratio ΦF/H1=0.1. For a diffuser with ratio of ΦF/H1=1, the gain is less but still some benefice is obtained at an opening angle around 18° to 20°. However, as discussed above, such long diffusers cannot be used for ACC's. As also known from literature, when using larger opening angles for conical diffusers, a so-called swirl effect may in certain situations occur. A swirl effect is a tangential rotation of flow and this may have a beneficial effect on the performance of the diffusers.

When there is very few space to add a diffuser, as is the case for an ACC, the question if adding a conical element is improving the fan performance or if adding a conical element will reduce the fan performance is complex as many parameters are involved such as for example the ratio S2/S1, the diffuser height, the shape of the velocity profile, the boundary layer thickness, the degree of flow turbulence at the entrance and the geometry of the upstream elements.

The inventors have performed numerical simulations for an ACC device according to the invention using computational fluid dynamics and demonstrated that when keeping the S2/S1 ratio and the ΦF/H1 ratio of the air-flow diffuser within the ranges as claimed, the total pressure drop is significantly improved when compared to the prior art systems where the ducted fan is directly coupled with the deck cover.

In table 1 below examples of dimensions of a conical air-flow diffuser falling within the claimed parameters are given. In the first column, the ratio between the inner diameter of the cylindrical duct of the ducted fan and the height H1 of the conical air-flow diffuser is given. The corresponding ratios S2/S1 are given in the second column. The corresponding opening angle α for a cone, as illustrated in FIG. 7, is given in the fourth column and is varying between 14° and 60°. In the third column, the ratio of H1+H2/ΦF used for these example is given as well. In practice, starting for example with a given fan size, the height of the air-flow diffuser can be determined. For example for a fan size of 11.05 m and when selecting a ratio ΦF/H1=11.05, the height H1 of the air-flow diffuser according to the invention is 1 m. In a second step, knowing the height H1, the corresponding S2/S1 ratio is determined and hence the cone angle to use for the conical diffuser can be determined from table 1. Table 1 can also be used when the air-flow diffuser has the shape of a right frustum. In that case the angle α is the opening angle between two sides of the frustum.

TABLE 1 dimensions for a conical air-flow diffuser according to the invention.

| ΦF/H1 | S2/S1 | H1 + H2/ΦF | Corresponding cone opening angle α(°) |
|---|---|---|---|
| 11.05 | 1.045 | 0.208 | 14 |
| 11.05 | 1.065 | 0.208 | 20 |
| 11.05 | 1.136 | 0.208 | 40 |
| 11.05 | 1.220 | 0.208 | 60 |
| 5.02 | 1.100 | 0.317 | 14 |
| 5.02 | 1.145 | 0.317 | 20 |
| 5.02 | 1.225 | 0.317 | 30 |
| 5.02 | 1.513 | 0.317 | 60 |
| 6.00 | 1.083 | 0.284 | 14 |
| 6.00 | 1.121 | 0.284 | 20 |
| 6.00 | 1.257 | 0.284 | 40 |
| 23.00 | 1.021 | 0.161 | 14 |
| 23.00 | 1.031 | 0.161 | 20 |
| 23.00 | 1.064 | 0.161 | 40 |
| 27.62 | 1.018 | 0.154 | 14 |
| 27.62 | 1.020 | 0.154 | 16 |
| 27.62 | 1.026 | 0.154 | 20 |
| 27.62 | 1.085 | 0.154 | 60 |

In a preferred embodiment, the air-flow diffuser 8 has a shape of a circular cone with a cone opening angle equal or larger than 14° and with 1.01≤S2/S1≤1.55 and 5≤(ΦF/H1)≤28.

In the table 2 here below, examples are given of dimensions an air-flow diffuser according to the invention wherein the inlet section has a circular shape and the outlet section is a square. As shown in column 2, with this air-flow diffuser geometry, the ratio S2/S1 is higher when compared to the conical case.

TABLE 2

Examples of dimensions for an air-flow diffuser according to the invention with circular inlet and square outlet.

| ΦF/H1 | S2/S1 | H1 + H2/ΦF |
|---|---|---|
| 11.05 | 1.330 | 0.208 |
| 11.05 | 1.400 | 0.208 |
| 11.05 | 1.553 | 0.208 |
| 5.02 | 1.401 | 0.317 |
| 5.02 | 1.559 | 0.317 |
| 5.02 | 1.926 | 0.317 |
| 6.00 | 1.379 | 0.284 |
| 6.00 | 1.600 | 0.284 |
| 23.00 | 1.300 | 0.161 |
| 23.00 | 1.404 | 0.161 |
| 27.62 | 1.296 | 0.154 |
| 27.62 | 1.341 | 0.154 |
| 27.62 | 1.382 | 0.154 |

The inventors have observed that the specific shape to be used for the air-flow diffuser is less critical. What is important is the S2/S1 ratio and the ΦF/H1 ratio and the fact that the cross section S is increasing from the air inlet side to the air outlet side of the air diffuser.

With these examples of table 1 and table 2, the results of the numerical simulations show that for S2/S1 ratios between 1.01 and 1.92 and for 5≤(ΦF/H1)≤28, the total pressure drop when compared to an ACC without air-flow diffuser is reduced. This pressure drop has to be construed as the total pressure drop resulting from the transition of the air-flow into the plenum space. This total pressure drops is a result of the fact that not all dynamic pressure is transformed into static pressure when the air enters the plenum. This difference in total pressure drop when comparing the embodiments according to the invention and the prior art embodiments without air-flow diffuser results in a reduction of the fan power consumption.

The inventors have made a detailed comparison of the fan electric power consumption between a prior art air-cooled condenser not using an air-flow diffuser and an exemplary air-cooled condenser according to the invention having a conical air-flow diffuser with an opening angle $\alpha$ of 40° and a height H1 of 1 m. In both cases the same ducted fan was used having a cylindrical duct with an inner circular diameter ΦF of 11.0 m and a fan providing an air-flow of 600 $m^3/s$. The result of this comparison is that the fan electrical power consumption of this exemplary air-cooled condenser according to the invention is reduced by 12% when compared with the prior art air-cooled condenser. For other air-flow diffusers falling within the dimensions given in tables 1 and 2, the numerical simulations show that similar results are obtained in terms of reduction of fan electrical power consumption.

As discussed above, the air-cooled condenser according to the invention comprises an air-flow diffuser wherein $1.01 \leq S2/S1 \leq 1.93$ and $5 \leq (\Phi F/H1) \leq 28$.

Preferably, in preferred embodiments of the invention, the air-cooled condenser comprises an air-flow diffuser wherein $1.05 \leq S2/S1 \leq 1.30$ and $8 \leq (\Phi F/H1) \leq 15$. With these preferred embodiments optimum results are obtained in terms of reduction of power consumption.

In further preferred embodiments, the air-cooled condenser has a shape of a hollow truncated right circular cone or a shape of a hollow right frustum wherein $1.01 \leq S2/S1 \leq 1.55$ and $5 \leq (\Phi F/H1) \leq 28$.

According to a preferred embodiment, the air-cooled condenser comprises an air-flow diffuser 8 having a shape of a circular cone with a cone opening angle $\alpha$ equal or larger than 14° and with $1.01 \leq S2/S1 \leq 1.55$ and $5 \leq (\Phi F/H1) \leq 28$.

The value H2, as shown on FIG. 3, is the height of the cylindrical duct 7 of the ducted fan. This height H2 is also measured along the axis Z. The height H2 is less critical for the overall performance in terms of pressure drop but in view of the above mentioned limitations with respect to the height of an ACC, it is beneficial to keep this value as low as possible. Therefore, in preferred embodiments, the sum of the height H1 of the air-flow diffuser 8 and the height H2 of the cylindrical duct 7 are kept within the range $0.15 \leq ((H1+H2)/\Phi F) \leq 0.32$, with ΦF being the inner diameter of the cylindrical duct 7 as mentioned above.

In embodiments according to the invention, the roof-shaped heat exchanger assembly comprises one or more first lateral panels 25, also named gable panels, positioned parallel with a plane formed by the axes Z and X such that a lateral boundary is formed for the plenum space 60. A gable panel 25 is for example shown in FIG. 5, illustrating the closing of the sides of the plenum space such that compressed air inside the plenum cannot escape through these side openings of the plenum space.

In other embodiments, as shown on FIG. 2*b*, one or more second lateral panels 26 are positioned parallel with a plane Z-Y formed by the axes Z and Y, so as to form a further lateral boundary for the plenum space 60.

As mentioned above, the invention is not limited to the number of fans used for blowing air into the plenum of a heat exchanger assembly. As illustrated on FIG. 5, embodiments according to the invention comprise a further ducted fan and further air flow diffuser. In this example, the deck cover 7 also comprises a further opening. The further ducted fan and the further air flow diffuser are configured such that when in operation, an air-flow generated by the further ducted fan is flowing through the further air flow diffuser before entering the plenum space 60 through the further opening in the deck 17.

The present invention has been described in terms of specific embodiments, which are illustrative of the invention and not to be construed as limiting. More generally, it will be appreciated by persons skilled in the art that the present invention is not limited by what has been particularly shown and/or described hereinabove. The invention resides in each and every novel characteristic feature and each and every combination of characteristic features. Reference numerals in the claims do not limit their protective scope. Use of the verbs "to comprise", "to include", "to be composed of", or any other variant, as well as their respective conjugations, does not exclude the presence of elements other than those stated. Use of the article "a", "an" or "the" preceding an element does not exclude the presence of a plurality of such elements.

The invention claimed is:

1. An air-cooled condenser for condensing steam, comprising a) one or more roof-shaped heat exchanger assemblies, wherein each heat exchanger assembly comprises a first heat exchanger panel and a second heat exchanger panel that are inclined with respect to a horizontal plane X-Y formed by a horizontal axis X and a longitudinal axis Y perpendicular to the axis X, b) a plenum space located between a top boundary delineated by the one or more roof-shaped heat exchanger assemblies and a bottom boundary delineated by a deck cover positioned parallel with said horizontal plane X-Y, and wherein said deck cover comprises a deck opening for receiving an air-flow, c) a ducted fan for blowing air flow into said plenum space, said ducted fan comprising a fan and a cylindrical duct surrounding said fan, and wherein the ducted fan is configured such that said fan is rotatable around a rotation axis R that is parallel with a vertical axis Z perpendicular to the axes X and Y, and said cylindrical duct has an inner circular diameter OF and a corresponding cross sectional area SF, wherein said air-cooled condenser further comprises an air-flow diffuser having an air inlet side connected to an upper side of the cylindrical duct and having an air outlet side coupled with said deck cover such that, when in operation, an air-flow generated by the fan is flowing through the air-flow diffuser before entering the plenum space via said deck opening, and wherein said air-flow diffuser has a height H1 measured along said vertical axis Z and an inner cross sectional area S obtained by intersecting said air-flow diffuser with a plane parallel with said horizontal plane X-Y, and wherein said inner cross sectional area S is increasing from a value $S1 \geq SF$ at said air inlet side to a value $S2 > S1$ at said air outlet side, and wherein $1.01 \leq S2/S1 \leq 1.93$ and $5 \leq (\Phi F/H1) \leq 28$.

2. An air-cooled condenser according to claim 1, wherein $1.05 \leq S2/S1 \leq 1.30$ and $8 \leq (\Phi F/H1) \leq 15$.

3. An air-cooled condenser according to claim 1, wherein said air-flow diffuser has a shape of a hollow truncated right circular cone or a shape of a hollow right frustum.

4. An air-cooled condenser according to claim 3, wherein $1.01 \leq S2/S1 \leq 1.55$ and $5 \leq (\Phi F/H1) \leq 28$.

5. An air-cooled condenser according to claim 1, wherein said air-flow diffuser has a shape of a circular cone with a cone opening angle $\alpha$ equal or larger than 14° and with $1.01 \leq S2/S1 \leq 1.55$ and $5 \leq (\Phi F/H1) \leq 28$.

6. An air-cooled condenser according to claim 1, wherein the cross sectional area S1 at the inlet side of said air-flow diffuser has a circular shape, and wherein the cross sectional area S2 at the outlet side of the air-flow diffuser has a square shape.

7. An air-cooled condenser according to claim 6, wherein $1.27 \leq S2/S1 \leq 1.93$ and $5 \leq (\Phi F/H1) \leq 28$.

8. An air-cooled condenser according to claim 1, further comprising a bell-mouth fan inlet or a conical fan inlet coupled to a bottom side of said cylindrical duct.

9. An air-cooled condenser according to claim 1, further comprising one or more first lateral panels positioned parallel with a plane Z-X formed by the axes Z and X and/or one or more second lateral panels positioned parallel with a plane Z-Y formed by the axes Z and Y, so as to form a lateral boundary for the plenum space.

10. An air-cooled condenser according to claim 1, wherein said cylindrical duct has a height H2 measured along said axis Z, and wherein $0.15 \leq ((H1+H2)/\Phi F) \leq 0.32$.

11. An air-cooled condenser according to claim 1, wherein the first and second heat exchanger panels of each of the one or more roof-shaped heat exchanger assemblies are separated by an opening angle $\delta$ in the range $35° \leq \delta \leq 70°$.

12. An air-cooled condenser according to claim 1, wherein said first and said second heat exchanger panels comprise condensing tubes having a length between 1.5 m and 2.5 m.

13. An air-cooled condenser according to claim 1, further comprising two to seven of said heat exchanger assemblies, and wherein the two to seven heat exchanger assemblies are positioned adjacently to each other so as to form a row of heat exchanger assemblies extending along the horizontal axis X, and wherein said two to seven heat exchanger assemblies are delineating said upper boundary of said plenum space.

14. An air-cooled condenser according to claim 1, further comprising an elevating frame structure resting on a ground floor and configured such that a distance HD, measured along the axis Z, between a center plane of the ducted fan and the ground floor is larger than 4 meters, said center plane is parallel with said horizontal plane X-Y.

15. An air-cooled condenser according to claim 1, further comprising a further ducted fan and a further air-flow diffuser configured such that, when in operation, an air-flow generated by the further ducted fan is flowing through the further air-flow diffuser before entering said plenum space via a further opening in said deck cover.

* * * * *